United States Patent [19]

Strommer

[11] Patent Number: 4,467,727

[45] Date of Patent: Aug. 28, 1984

[54] LIGHT BOX APPARATUS

[76] Inventor: Stanley R. Strommer, 1729 N Snelling Ave., Falcon Heights, Minn. 55113

[21] Appl. No.: 418,722

[22] Filed: Sep. 16, 1982

[51] Int. Cl.[3] ..... A47B 85/00

[52] U.S. Cl. ..... 108/23; 248/456; 108/9

[58] Field of Search ..... 108/6, 23, 9; 248/456

[56] References Cited

U.S. PATENT DOCUMENTS

| | | | |
|---|---|---|---|
| 388,158 | 8/1888 | Thompson | 108/23 |
| 472,099 | 4/1892 | Wyns | 108/23 |
| 1,203,659 | 11/1916 | Smith | 248/456 |
| 1,490,917 | 4/1924 | Finkelstein | 108/23 |
| 2,219,091 | 10/1940 | Henderson | 248/456 |
| 2,563,671 | 8/1951 | Basinger | 248/456 |
| 3,104,492 | 9/1963 | Banks | 108/23 |
| 3,163,939 | 1/1965 | Heyer | 108/23 X |

*Primary Examiner*—Francis K. Zugel
*Attorney, Agent, or Firm*—Robert C. Baker

[57] ABSTRACT

Provided is a collapsible, easily cleaned, flat folding, storable, lightweight, readily portable and adjustable artist's light box apparatus. The apparatus has a base plate which serves as the foundational structure plate. It has an upper transparent plate or organic plastics material in spaced relationship over the base plate. Hinge means adjacent forward portions of the side edges of the transparent plate and base plate provides for pivotal elevational tilting of the transparent plate above the base plate. An adjustable means is provided for temporarily locking the transparent plate at any of a multiplicity of preselected tilt angles with respect to the base plate. The bottom of the base plate is provided with friction means for anti-slip temporary resting of the base plate on a planar surface. Snap closure means is provided for temporarily locking the transparent plate in folded relationship to the base plate for storage or portability of the apparatus. The total thickness of the apparatus is no greater than about one inch when the transparent plate is temporarily locked in folded relationship to the base plate.

4 Claims, 2 Drawing Figures

LIGHT BOX APPARATUS

This invention relates to an artist's light box apparatus and to a method of using the same for convenient tracing of a base drawing directly onto a final sheet. More particularly, the invention is directed to an extraordinarily simple light box apparatus which is collapsible, easily cleaned, flat folding, storable, readily portable, and easily adjustable, as well as to the method of using the apparatus with great convenience to effectively permit final sheet preparation of a drawing from a base drawing in the form of a sketch or the like.

PRIOR ART PROBLEMS

Light boxes illuminated from within have been heretofore known. Commonly they have frosted glass tops, have depths of three inches or more so as to accommodate a fluorescent tube or the like, are heavy and cumbersome, and while useful on a flat table, are difficult to use on a sloping surface which sometimes is preferred as the base working surface by artists.

SUMMARY OF THE INVENTION

This invention provides a collapsible, easily cleaned, flat folding, storable, lightweight, readily portable and adjustable artist's light box apparatus. The apparatus has a base plate which more or less is the foundational structure plate. It also has an upper transparent plate of organic plastics material in spaced relationship over the base plate. Hinge means adjacent forward portions of the side edges of the transparent plate and base plate provides for pivotal elevational tilting of the transparent plate above the base plate. An adjustable means is provided for temporarily locking the transparent plate at any of a multiplicity of preselected tilt angles with respect to the base plate. The bottom of the base plate is provided with friction means for anti-slip temporary resting of the base plate on a planar surface, even a sloping planar surface such as generally preferred by artists as the base surface on which to conduct their work. Further, snap closure means is provided for temporarily locking the transparent plate in folded relationship to the base plate for storage or portability of the light box apparatus. The total thickness of the light box apparatus is no greater than about one inch when the transparent plate is temporarily locked in folded relationship to the base plate.

Still other advantageous features and functional relationships will become apparent as this description proceeds.

DRAWING

The invention will be described with the aid of a drawing, made a part hereof, and offered solely for purposes of illustration and not in limitation, wherein.

DESCRIPTION OF PREFERRED EMBODIMENT

Figure 1:
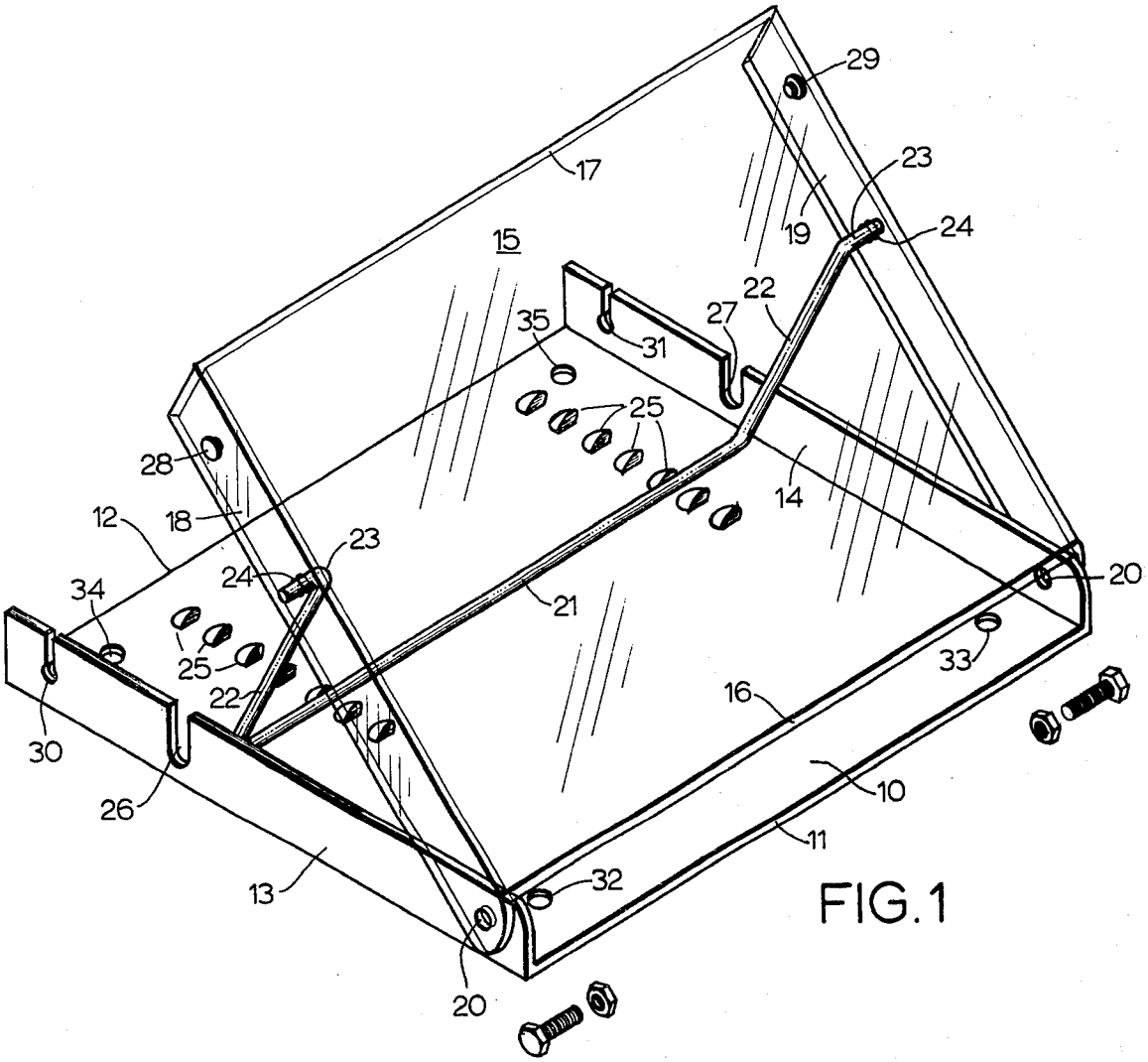
FIG. 1 is a schematic perspective view of the light box apparatus.

Referring particularly to FIG. 1, the base plate 10 of the light box apparatus will first be described. Generally this base plate is essentially rectangular in configuration, as illustrated, although it may be square or even have some portions of the illustrated base plate entirely omitted. Fundamentally, the base plate serves as a foundation structure; and in that respect it need not be continuous in nature. Portions of the illustrated plate may be broken away, if desired. Importantly however, the base plate should have no upward flange along the forward 11 and rear 12 edges thereof. Instead, those edges should terminate in essentially the same plane as the base plate per se. However, each side edge of the base plate should have an upwardly flanged section such as identified by numerals 13 and 14 in the drawing. Again, it is optional to omit portions of the upwardly flanged section as illustrated in the drawing, if desired.

Above the base plate is an upper transparent plate 15. This transparent plate is made of organic plastics material, preferably or illustratively of polymethyl methacrylate (commonly called "plexiglas") or polycarbonate, although acetate plastics sometimes may be useful. The transparent plate 15 is in spaced relationship over the base plate whether it is in folded and collapsed condition over the base plate or in the elevated condition illustrated. There is no downwardly extending flange along the forward or front edge 16 of the transparent plate. Indeed, there is preferably not even an upwardly extending flange along that edge. The front edge or forward edge 16 of the transparent plate should terminate in the same plane as the plate 15 itself, just as in the case of the forward edge 11 for the base plate 10. There is a reason for this. The spacing of the plates and the hinging to be discussed are such as to allow ready access at the front or forward edge for the purpose of cleaning the underside of the transparent plate even while an artist is engaging in actual use of the apparatus and does not want to tip or tilt it and disrupt the arrangement he has made for materials that he has settled upon for his particular use.

Further, the rear edge 17 of the transparent plate 15 is most preferably not equipped with any flange. But the side edges of the transparent plate 15 are indeed equipped with downwardly extending flanges 18 and 19. As in the case of the side edge flanges 13 and 14 for the base plate 10, these downward flanges or flange sections 18 and 19 for the transparent plate may have parts broken away as compared to the uniformity for them illustrated in the drawing.

Connecting adjacent forwardmost portions of the side edge flange sections of both the transparent plate and the base plate are hinges. Suitably a hole extends through the forwardmost portion of the side edge flange sections of each plate member; and holes 20 at the forwardmost portion of the side edge flange sections for both plate members are illustrated in the drawing for this connecting purpose. Illustratively, a rivet may be placed through these holes for the hinge connection; or any nut and bolt or other suitable hinge or fastening means for pivotal elevational tilting of the transparent plate above the base plate may be used.

Suitable adjustable means for temporarily locking the transparent plate at any of a multiplicity of preselected tilt angles with respect to the base plate may comprise the combination of a bail rod 21 assembled for pivotal action in flanges 18 and 19 of the transparent plate plus lug members 25 projecting upwardly from the upper surface of the base plate 10. The bail rod or brace 21 illustratively extends as a straight member adapted to be latched or locked against a lug 25 of the base plate, with the depending straight part of member 21 depending from arms 22 which terminate in laterally or outwardly directed rod elements 23 fitted for pivotal action within holes 24 of the side edge flange members of the transparent plate. Lug members 25 on the base plate are preferably located in two lines or spaced locations for maximum stability of the temporary locking of the adjustable means. Illustratively, the lugs 25 are located in pairs at spaced apart locations; and a line of lugs extends from the rear edge of the base plate to a forward location from that rear edge but not so far forwardly as to extend to the front edge 11 of the base plate. To be observed is that the drawing illustrates cutout parts 26 and 27 in the flange members 13 and 14 of the base plate. These cutout portions are to accommodate the terminus portions 23 of the composite rod 21 when the transparent plate 15 is folded to the base plate 10.

Folding of the transparent plate downwardly to place it flattened substantially parallel relationship with the base plate is easily accomplished by tilting the rod 21 mechanism in a forward direction.

A snap closure means is provided for temporarily locking the transparent plate in a folded or flattened substantially parallel relationship to the base plate for storage or portability of the entire light box apparatus. Illustratively, the snap closure means is cooperatively functional at adjacent portions of the side edge flanged sections of the transparent plate and base plate. For example, the base plate is equipped with holes or openings 30 and 31 in its side flanges 13 and 14. The holes 30 and 31 are preferably toward the rear portion of the flanges 13 and 14. Each hole is provided with an access slot extending from the upper edge of the flanges 13 and 14. Knobular elements 28 and 29 project outwardly from the flanges 18 and 19 of the transparent plate. These knobular elements 28 and 29 are so mounted as to register and enter the slots leading to the holes 30 and 31 in the side flanges of the base plate when the transparent plate is pivotally lowered about the hinge means 20 as the entire assembly is collapsed to a flattened condition with the transparent plate substantially parallel with the base plate. The knobular elements 28 and 29 are suitably formed of organic plastics material and mounted in position on the flanged sections of the transparent plate in any suitable manner. For example, knobular elements 28 and 29 may be formed of polyethylene or any other yieldable material which is readily capable of slight compression to slip through the slots leading to holes 30 and 31 but slightly expanding after passing through the slots so as to temporarily remain within the holes 30 and 31 and retain the composite apparatus in collapsed condition for storage or portability.

Figure 2:
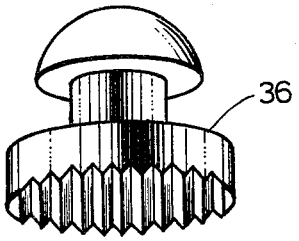
FIG. 2 is a schematic perspective view of a rubber foot element for the light box apparatus.

Illustrated near the four corners of the base plate 10 are holes 32, 33, 34, and 35. These holes are adapted to receive the mushroom top of the foot element 36 illustrated in FIG. 2. The foot element 36 is suitably made of rubber or a rubber-like material, or at least a material having a friction characteristic along its lowermost surface. The bottom of the foot element 36 is suitably textured or provided with a tread for better traction or anti-slip characteristics. Frequently the base working surface for an artist is smooth or slick; and a textured anti-slip bottom surface for feet 36 of the light box apparatus is functionally effective under such conditions. Optionally however, the holes 32 through 35 inclusive may be omitted from the structure of the base plate 10 and an anti-slip sheet material may be adhesively secured to the bottom, if desired. Suitable friction means on the bottom of the base plate however does provide for anti-slip temporary resting of the base plate on a planar surface even when the planar or underlying surface is smooth and even when the underlying surface may itself be at somewhat of a tilt from the horizontal.

Importantly, the spaced relationship of the transparent plate over the base plate is such that the total thickness of the light box apparatus is no greater than about one inch when the transparent plate is temporarily locked in folded relationship to the base plate. Further, the tilt relationship between the transparent plate and base plate is such as to permit a mobile or portable light source to be temporarily inserted therebetween in a convenient manner.

In use, the artist is provided with great convenience. The method of using the light box to trace a base drawing directly onto a final sheet provides for great speed as well as convenience. First, the apparatus, and particularly the friction means or feet of the base plate, is rested on a planar surface with the hinged connection at number 20 nearest the position to be occupied by the artist while he is working. The artist temporarily unlocks the snap closure means. Then the transparent plate is temporarily locked at a tilt angle with respect to the base plate as selected by the artist.

Continuing the steps of use, the artist directs light from a separate mobile light source upwardly through the tilted transparent plate of the apparatus. He places a base drawing or sketch that he wishes to trace directly upon the upper surface of the transparent plate. Suitably he may temporarily secure the base drawing to the transparent plate by affixing adhesive masking tape or the like to peripheral portions of base drawing to hold it on the transparent plate. Then he overlays upon the base drawing the final sheet onto which he wishes to trace the base drawing. He may temporarily secure the final sheet in place with removable adhesive tape. The artist is able to view the final sheet drawing in the same manner in which it will be viewed as the final product. He traces the base drawing directly upon the final sheet by using pen, pencil or any other instrument or marking system as desired for the visual effects of the drawing on the final sheet.

An interesting feature on folding the apparatus as aforediscussed is that the rod 21 may be pivoted to extend slightly outside the rear edges of the plates and serve as a handle member for carrying the folded apparatus. It alternatively may be pivoted to lie totally within the folded confines of the plates, if desired.

The base plate itself, including its lugs, is suitably molded and formed of organic plastics material, although metal may be employed, if desired.

While the invention has been described with particular reference to the preferred embodiments, insubstantial variations as well as equivalents are likewise comprehended.

That which is claimed is:

1. A collapsible, easily cleaned, flat folding, storable, lightweight, readily portable and adjustable artist's light box apparatus, consisting of a base plate having no upward flange along the forward and rear edges thereof but having an upwardly flanged section along each side edge thereof, an upper transparent plate wholly of organic plastics material in spaced relationship over said base plate, said upper transparent plate having a downwardly flanged section along each side edge thereof but no downwardly flanged section along the forward and read edges thereof, hinge means adjacent forward portions of the side edge flange sections of said transparent plate said base plate for pivotal elevational tilting of said transparent plate above said base plate, adjustable means for temporarily locking said transparent plate at any of a multiplicity of preselected tilt angles with respect to said base plate, said adjustable means comprising a bail rod pivotally mounted in the downwardly flanged section of each side edge of the transparent plate, friction means on the bottom of said base plate for anti-slip temporary resting of said base plate on a planar surface, and snap closure means for temporarily locking said transparent plate in folded relationship to said base plate for storage or portability of said light box apparatus, said snap closure means consisting of cooperatively interlocking functional elements located at adjacent rearward portions of said side edge flanged sections of said transparent plate and said base plate, the total thickness of said light box apparatus being no greater than about one inch when said transparent plate is temporarily locked in folded relationship to said base plate, and said pivotally mounted bail rod being further characterized by being pivotable to extend outside the rear edges of the base plate and transparent plate and serve as a carrying handle when said plates are temporarily locked in said folded relationship.

2. The light box apparatus of claim 1 wherein said friction means comprises foot members mounted in said base plate.

3. The light box apparatus of claim 2 wherein said foot members are equipped with a textured bottom foot surface.

4. The method of using the artist's light box apparatus of claim 1 to trace a base drawing directly onto a final sheet, comprising a. resting the friction means of said base plate on a planar surface with the hinge means of said apparatus nearest the position of the artist,
b. temporarily unlocking said snap closure means,
c. temporarily locking said transparent plate at a tilt angle with respect to said base plate as selected by the artist,
d. directing light from a mobile light source upwardly through said transparent plate,
e. placing a base drawing to be traced directly upon the upper surface of said transparent plate,
f. overlaying on said base drawing the final sheet onto which said base drawing is to be traced, and
g. tracing said base drawing directly upon said final sheet while observing said base drawing through said final sheet with the air of said mobile light source.

* * * * *

UNITED STATES PATENT AND TRADEMARK OFFICE

CERTIFICATE OF CORRECTION

PATENT NO. : 4,467,727

DATED : Aug. 28, 1984

INVENTOR(S) : Stanley R. Strommer

It is certified that error appears in the above-identified patent and that said Letters Patent is hereby corrected as shown below:

In the Abstract:

Line 5 - "or" should read "of"

In the Claims:

Col. 4, line 65 - "read" should read "rear"

Col. 4, line 67 - After "plate", first occurrence, and before "said base plate", read the word --and--.

Col 6, line 25 - "air" should read "aid"

Signed and Sealed this

Nineteenth Day of February 1985

[SEAL]

*Attest:*

DONALD J. QUIGG

*Attesting Officer* *Acting Commissioner of Patents and Trademarks*